US008303165B2

(12) United States Patent
Wang

(10) Patent No.: US 8,303,165 B2
(45) Date of Patent: Nov. 6, 2012

(54) MAGNETIC STIRRING MECHANISM

(76) Inventor: Wade Lee Wang, Shulin (TW)

( * ) Notice: Subject to any disclaimer, the term of this patent is extended or adjusted under 35 U.S.C. 154(b) by 159 days.

(21) Appl. No.: 12/963,662

(22) Filed: Dec. 9, 2010

(65) Prior Publication Data

US 2012/0147697 A1 Jun. 14, 2012

(51) Int. Cl.
*B01F 11/00* (2006.01)
*B01F 13/08* (2006.01)

(52) U.S. Cl. ..... 366/237; 366/273

(58) Field of Classification Search ..... 366/197–240, 366/273–274
See application file for complete search history.

(56) References Cited

U.S. PATENT DOCUMENTS

| | | | | |
|---|---|---|---|---|
| 3,607,478 | A * | 9/1971 | Henninges et al. | 366/208 |
| 3,643,671 | A * | 2/1972 | Henninges et al. | 366/209 |
| 7,008,100 | B2 * | 3/2006 | Sergio | 366/110 |
| 7,520,657 | B2 | 4/2009 | Andrews et al. | |
| 2012/0147697 | A1 * | 6/2012 | Wang | 366/273 |

* cited by examiner

*Primary Examiner* — Charles E Cooley
(74) *Attorney, Agent, or Firm* — Bacon & Thomas, PLLC

(57) ABSTRACT

The present invention provides a stirring mechanism with magnetic force. It has a central rotary arm with permanent magnet, as well as a plurality of lever arms, each having one respective permanent magnet. A track disk rotates synchronously with the central rotary arm. An elliptic track slot in the track disk traps the lever arms to swing forward and backward. The lever arms exhibit alternate motions of approaching and leaving, thereby causing a stirring effect.

6 Claims, 7 Drawing Sheets

MAGNETIC STIRRING MECHANISM

FIELD OF THE INVENTION

The present invention relates to a stirring mechanism with magnetic force, and more particularly to a stirring mechanism having a central rotary arm with a permanent magnet, several lever arms each having a permanent magnet respectively, and a track disk that rotates synchronously with the central rotary arm.

BACKGROUND OF THE INVENTION

Due to the fast progress of material technology of permanent magnet, a small NdFeB permanent magnet with diameter 60 mm can attract up a steel plate with 1000 kilogram.

Conventional stirring mechanism includes a simple mechanical motion for stirring without using the attractive and repulsive force of the permanent magnet.

U.S. Pat. No. 7,520,657 discloses a magnetic stirring system that includes a stir-mantle and a magnetic stirring apparatus used for stirring/mixing materials in a flask. A rare-earth magnet is mounted on the magnetic stirring apparatus and is driven in rotation by a pneumatic motor. The rare-earth magnet is coupled to a magnetic stir bar in the flask for joint rotation so that the stir-bar stirs/mixes the materials in the flask. An exhaust is included to channel air from the motor to the rare-earth magnet and to direct the air to flow over the magnet to control the temperature of the magnet.

SUMMARY OF THE INVENTION

The object of the present invention is to provide a stirring mechanism with magnetic force, comprising:

a central rotary arm equipped with a permanent magnet;

a plurality of lever arms each with a permanent magnet being equipped at a lower concave part thereof;

a track disk having an elliptic track slot formed therein for trapping the lever arms swing forward and backward;

an axle passing through a central hole of the central rotary arm and a center of the track disk;

a case accommodating the all above and supporting the axle with an upper bearing and a lower bearing.

The track disk rotates synchronously with the central rotary arm, and the elliptic track slot on the track disk can trap lever arms to swing forward and backward. Thus the lever arms can exhibit alternate motions for approaching and leaving so as to cause a stirring effect.

DETAILED DESCRIPTIONS OF THE PREFERRED EMBODIMENTS

Figure 1:
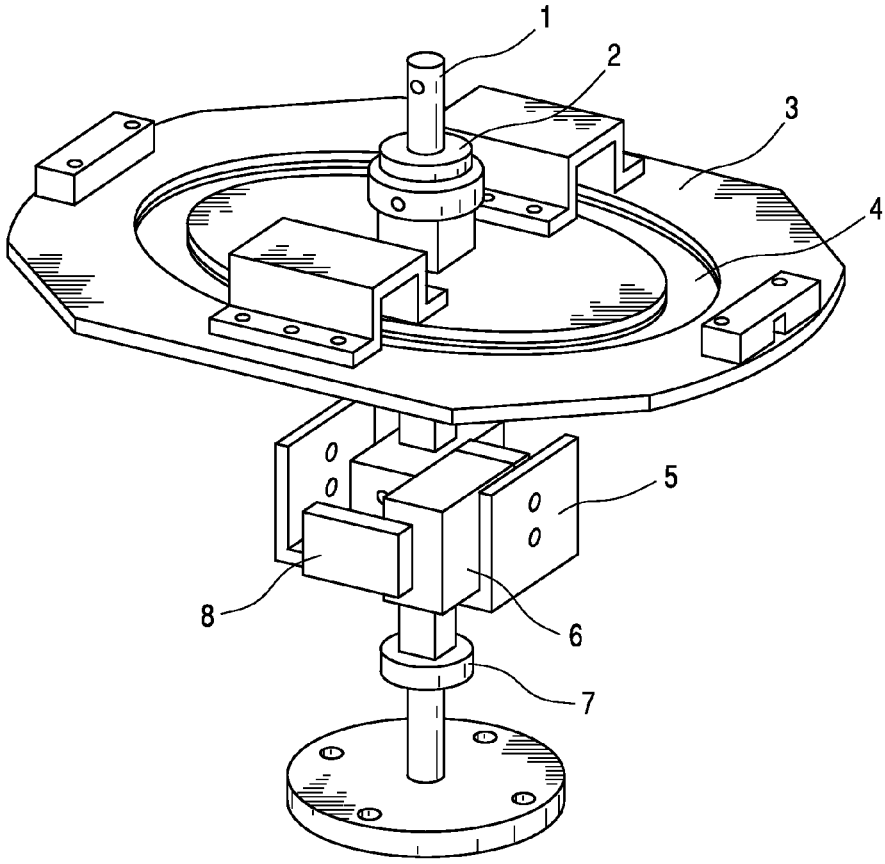
FIG. 1 shows schematically the central rotation mechanism.

Referring to FIG. 1, it shows the central rotation mechanism. An axle 1 is equipped with a upper bearing 2 and a lower bearing 7 for being disposed within an upper cover 28 and a lower cover 29 of a case 33 (see FIG. 7). A track disk 3 is fixed on the axle 1, an elliptic track slot 4 is formed in the track disk 3 to trap the lever arm 15 (see FIG. 3) to swing forward and backward therein. A central rotary arm 5 is fixed on the axle 1 and is equipped with a permanent magnet 6 in the concave part thereof. An iron plate 8 is attracted on the permanent magnet 6 to change the distribution of the magnetic flux lines.

Figure 2:
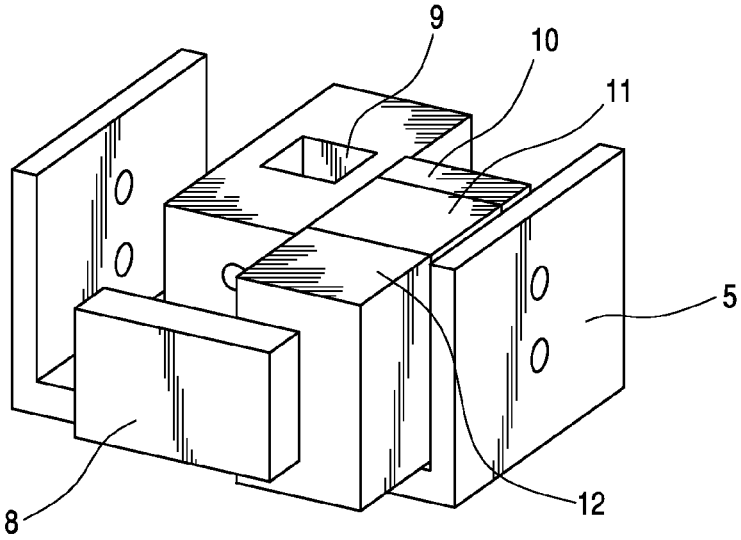
FIG. 2 shows schematically the central rotary arm.

Referring to FIG. 2, the axle 1 passes through a central hole 9 of the central rotary arm 5 so that the central rotary arm 5 is fixed on the axle 1. An iron plate 10 is fixed in the concave part of the central rotary arm 5 for attracting the permanent magnet 6 at the southern pole 11, while an iron plate 8 is attracted on the permanent magnet 6 at the northern pole 12 to change the distribution of the magnetic flux lines.

Figure 3:
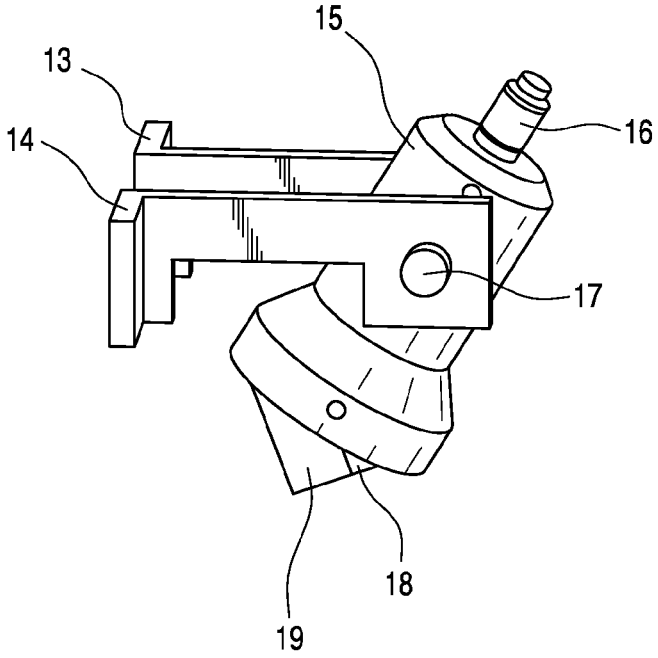
FIG. 3 shows schematically the lever arm in a backward position.
Figure 4:
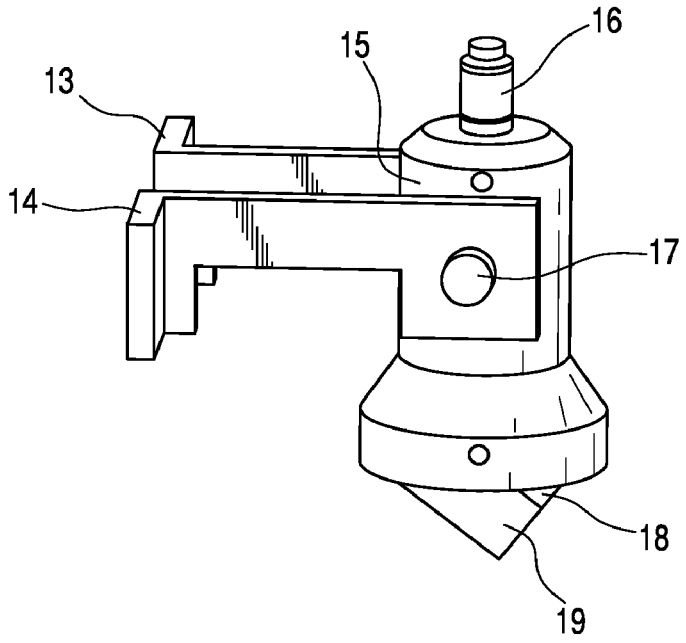
FIG. 4 shows schematically the lever arm in a forward position.

Referring to FIGS. 3 and 4, a supporting axle 17 passes through a left holder 14, a lever arm 15 and a right holder 13 so that the lever arm 15 can swing forward and backward freely. A rolling ring 16 is set on the head of the lever arm 15 for sliding in the elliptic track slot 4 with very low friction. The lower part of the lever arm 15 has a concave part for setting a permanent magnet 27 (see FIGS. 6 and 7) having southern pole 18 and northern pole 19. FIG. 3 shows that the lever arm 15 swung backward, while FIG. 4 shows that the lever arm 15 swung forward.

Figure 5:
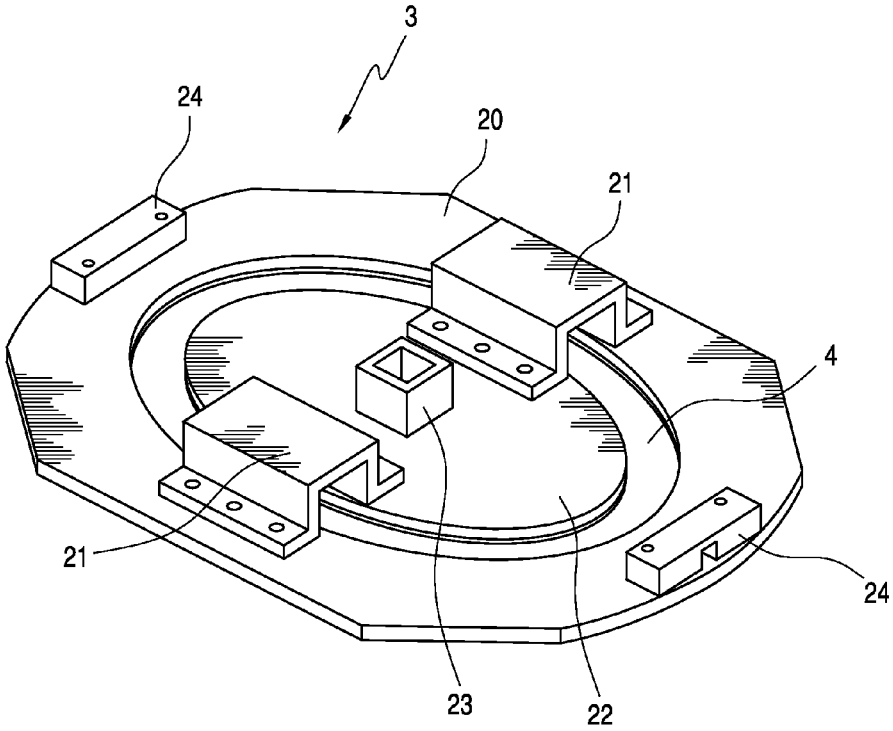
FIG. 5 shows schematically the track disk.

Referring to FIG. 5, the track disk 3 is composed of outer ring 20 and inner ring 22 with an elliptic track slot 4 in between. Two connecting bridges 21 are used for connecting outer ring 20 and inner ring 22. The axle 1 passes through a block 23 in the center of the inner ring 22 for maintaining the track disk 3 horizontally. A rod (not shown) can pass through a hole of the side cover 31 (see FIG. 7) and then enters the hole of the fixing block 24 so that the track disk 3 is rendered immovable, thereby facilitating the installation of permanent magnet 6.

Figure 6:
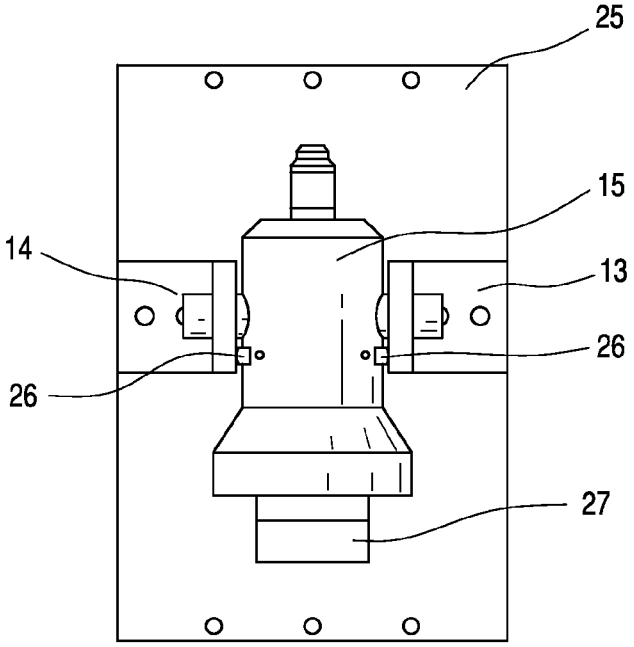
FIG. 6 shows schematically the left cover mechanism.
Figure 7:
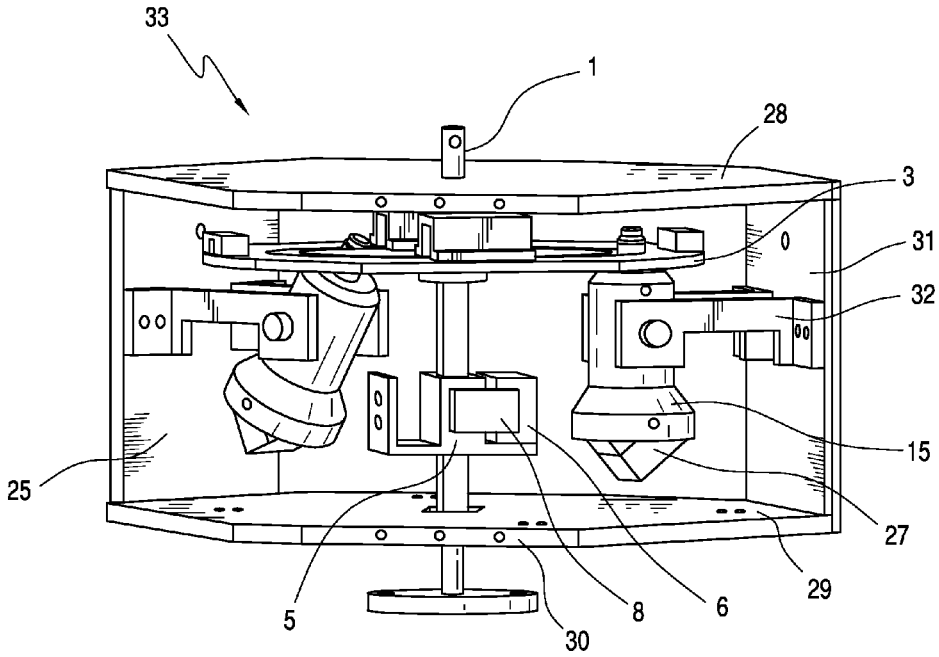
FIG. 7 shows schematically the total mechanism in the case.

Referring to FIG. 6, the lever arm 15 is supported by the left holder 14 and the right holder 13 which are fixed on a side cover 25 of the case 33 (see FIG. 7). Two wear-resisting blocks 26 are fixed on opposed sides of the lever arm 15 for preventing direct wearing and tearing between lever arm 15, left holder 14 and right holder 13. It also can decrease the friction of lever arm 15 and increase the lifetime of the lever arm 15. A permanent magnet 27 is disposed into the lower concave part of the lever arm 15.

The left holder 14 and the right holder 13 can resist the attractive/repulsive magnetic force between the permanent magnet 27 and the permanent magnet 6 (see FIG. 7). Three permanent magnets 27 are equipped respectively into the lower concave part of three lever arms 15, all with the northern pole downward and the southern pole upward.

Referring to FIG. 7, the schematic view of the mechanism of the present invention with the front side open is shown. A case 33 is composed of an upper cover 28, a lower cover 29, a front cover 30 (not shown), a left cover 25 and a right cover 31. Three lever arms 15 are equipped on the three side covers 25, 30, 31 respectively by six holders 32. Permanent magnets 27 are disposed in the lower concave part of the three lever arms 15 respectively. The central rotary arm 5 has a concave part for receiving a permanent magnet 6. The iron plate 8 is attracted on the permanent magnet 6. The track disk 3 is fixed on the axle 1.

As the central rotary arm 5 rotates with the track disk 3 (e.g. a belt wheel is equipped on the bottom of the axle 1, and permit a motor to drive a belt wheel to rotate the axle 1. The elliptic track slot 4 on the track disk 3 is used to trap one side of the lever arm 15 and let the lever arm 15 swing forward and backward when the track disk 3 is rotating. Therefore the attractive/repulsive magnetic force between the permanent magnet 27 and the permanent magnet 6 can generate a stirring effect.

When the axle 1 rotates to a position that the major axis of the elliptic track slot 4 traps the lever arm 15, the permanent magnet 27 approaches the permanent magnet 6. When the axle 1 rotates to a position that the minor axis of the elliptic track slot 4 traps the lever arm 15, the permanent magnet 27 leaves the permanent magnet 6. The greater the length difference of the major axis and the minor axis, the greater the swing amplitude. The elliptic track slot 4 permits the permanent magnet 27 to quickly approach or leave the permanent magnet 6.

The direction of the northern pole and the southern pole of the permanent magnet 6 is along the tangent direction of the rotation of the central rotary arm 5. The permanent magnets 27 of the three lever arms 15 are arranged with the northern pole downward and the southern pole upward.

As the central rotary arm 5 rotates with the track disk 3 (e.g. a belt wheel is equipped on the bottom of the axle 1, and let a motor drive the belt wheel to rotate the axle 1, the three lever arm 15 will be trapped by the elliptic track slot 4 on the track disk 3 and swing forward and backward alternately, thus the permanent magnet 6 only rotates in one direction, and will never rotate in reverse.

In order to increase the magnetic force of the swing, either by increasing the size of the magnet (enlarge the total mechanism and the case 33) or by decreasing the distance between the magnet 27 and the magnet 6, but the distance can't be too short to let the central rotary arm 5 not hit the lever arm 15, and the magnet 27 must not attracted by iron plate 8.

Magnet 27 can be a cubic type permanent magnet, while magnet 6 can be a rectangular permanent magnet.

A plurality of layers of the present mechanism can be piled up. The central rotary arms 5 of the plutality of layers share only one axle 1. The lever arms 15 of the plutality of layers are arranged with different angles (for example, if first floor is 0°, 120°, 240° then second floor is 60°, 180°, 270°) to relay magnetic force.

The magnet 27 of the lever arm 15 must be arranged at the lower part of the case 33, while the track disk 3 must be arranged at the upper part of the case 33, so that the track disk 3 will not support the weight of the magnets 27 of the lever arms 15 so as to make the rotation smooth.

The iron plate 8 is attracted on the permanent magnet 6 at the northern pole 12 to change the distribution of the magnetic flux lines so as to avoid reverse rotating force be generated when the magnet 6 is going to leave the magnet 27.

When axle 1 rotates to a position that the angle between the permanent magnet 6 and the permanent magnet 27 is 120°, the distance between the permanent magnet 6 and the permanent magnet 27 should be long enough so that there is no magnetic force influence exist between the permanent magnet 6 and the permanent magnet 27. The dimension of the track disk 3 and central rotary arms 5 is designed with the above principle, so as to achieve a best stirring performance.

The permanent magnet 6 is only set at one side of the concave part of the central rotary arm 5. Two permanent magnets 6 setting at both sides of the concave part of the central rotary arm 5 are not permissible, since reverse magnetic flux lines will be formed.

A rolling ring 16 (see FIG. 3) is set on the head of the lever arm 15 for sliding in the track slot 4 with very low friction.

The scope of the present invention depends upon the following claims, and is not limited by the above embodiments.

What is claimed is:

1. A stirring mechanism with magnetic force, comprising:

a central rotary arm equipped with a permanent magnet;

a plurality of lever arms each with a permanent magnet being equipped at a lower concave part thereof;

a track disk having an elliptic track slot formed therein for trapping the lever arms swing forward and backward;

an axle passing through a central hole of the central rotary arm and a center of the track disk;

a case accommodating the all above and supporting the axle with an upper bearing and a lower bearing;

the track disk rotates synchronously with the central rotary arm, and the elliptic track slot on the track disk can trap lever arms to swing forward and backward, thus the lever arms can exhibit alternate motions for approaching and leaving so as to cause a stirring effect.

2. The stirring mechanism with magnetic force according to claim 1, wherein the lever arm is supported by a left holder and a right holder on a side cover of the case; two wear-resisting blocks are fixed on two side of the lever arm respectively for preventing from direct wearing and tearing between the lever arm, the left holder and the right holder; a rolling ring is set on a head of the lever arm for sliding in the elliptic track slot with very low friction.

3. The stirring mechanism with magnetic force according to claim 1, wherein the direction of the northern pole and the southern pole of the permanent magnet on the central rotary arm is along the tangent direction of the rotation of the central rotary arm; the permanent magnets of the lever arms are arranged with the northern pole downward and the southern pole upward.

4. The stirring mechanism with magnetic force according to claim 1, wherein a plurality of layers of the stirring mechanism can be piled up; the central rotary arms of the plutality of layers share the axle; the lever arms of the plutality of layers are arranged with different angles to relay magnetic force.

5. The stirring mechanism with magnetic force according to claim 1, wherein an iron plate is attracted on an outside pole of the permanent magnet of the central rotary arm; and the permanent magnet of the central rotary arm is only set at one side of a concave part of the central rotary arm.

6. The stirring mechanism with magnetic force according to claim 1, wherein the distance between the permanent magnet of the central rotary arm and the permanent magnet of the lever arm should be long enough so that there is no apparent magnetic force influence existing between the permanent magnet of the central rotary arm and the permanent magnet of the lever arm when the axle rotates to a position that the angle between the permanent magnet of the central rotary arm and the permanent magnet of the lever arm is 120°.

* * * * *